US009648939B2

(12) United States Patent
Shieh

(10) Patent No.: US 9,648,939 B2
(45) Date of Patent: May 16, 2017

(54) POWDER BAG STRUCTURE

(71) Applicant: Jang-Tian Shieh, New Taipei (TW)

(72) Inventor: Jang-Tian Shieh, New Taipei (TW)

( * ) Notice: Subject to any disclaimer, the term of this patent is extended or adjusted under 35 U.S.C. 154(b) by 591 days.

(21) Appl. No.: 14/160,771

(22) Filed: Jan. 22, 2014

(65) Prior Publication Data

US 2014/0209494 A1 Jul. 31, 2014

(30) Foreign Application Priority Data

Jan. 25, 2013 (TW) ..... 102103035 A
Mar. 26, 2013 (TW) ..... 102110567 A

(51) Int. Cl.

| | |
|---|---|
| ***B65D 85/00*** | (2006.01) |
| ***A63B 29/02*** | (2006.01) |
| ***A45F 3/00*** | (2006.01) |
| ***A63B 29/08*** | (2006.01) |
| ***A45F 5/02*** | (2006.01) |
| ***A45C 13/02*** | (2006.01) |
| *A45C 3/00* | (2006.01) |

(52) U.S. Cl.

CPC ..... *A45F 3/005* (2013.01); *A45C 13/02* (2013.01); *A45F 5/021* (2013.01); *A63B 29/08* (2013.01); *A45C 2003/007* (2013.01); *A63B 2209/10* (2013.01)

(58) Field of Classification Search

CPC ..... A63B 29/08; A63B 2209/10; A45F 3/005; A45F 5/021; A45C 13/02; A45C 2003/007

USPC ..... 206/37, 38, 315.1; 190/111, 124; 224/674; 383/12, 21, 33, 38, 40, 43, 383/61.1–61.4, 117; 401/200

See application file for complete search history.

(56) References Cited

U.S. PATENT DOCUMENTS 3,473,699 A * 10/1969 Pike ..... A01K 13/003 222/105
4,386,642 A * 6/1983 Durbin ..... A45C 3/00 190/110
5,609,419 A * 3/1997 Byers, Jr. ..... A45C 13/06 224/674
6,139,185 A * 10/2000 Hamilton ..... B65D 33/14 220/495.11
6,171,006 B1 * 1/2001 Woodall ..... A63B 71/00 401/196
6,234,674 B1 * 5/2001 Byers, Jr. ..... A45C 13/10 24/30.5 R
6,349,414 B1 * 2/2002 Tillman ..... A41D 20/00 2/170
9,427,067 B2 * 8/2016 Satterfield ..... A45F 3/005
(Continued)

*Primary Examiner* — Luan K Bui
(74) *Attorney, Agent, or Firm* — patenttm.us

(57) ABSTRACT

The present invention provides a powder bag. The powder bag having a top and a first mouth at the top includes a bag body configured to have an internal wall, a major space and a secondary space, wherein the major space and the secondary space is partitioned by a partition interface; and the secondary space configured to have a second mouth and a second switch element for opening and closing the second mouth, connected with the internal wall and used for containing a powdery substance, wherein the partition interface has a porous surface with a plurality of pores and each of the plurality of pores having a dimension which allows a part of the powder substance to transfer from the secondary space to the major space.

20 Claims, 7 Drawing Sheets

(56) References Cited

U.S. PATENT DOCUMENTS

| | | | | |
|---|---|---|---|---|
| 2013/0014792 | A1* | 1/2013 | Brensinger | A47K 3/288<br>135/95 |
| 2014/0348567 | A1* | 11/2014 | Delisle | A61Q 19/00<br>401/200 |

* cited by examiner

POWDER BAG STRUCTURE

FIELD

The present invention relates to a powder bag, and in particular relates to a climbing chalk bag.

BACKGROUND

Quite a few exercises or activities, such as rock climbing, mountaineering, gymnastics, aloft work, painting work and so on, are heavily dependent upon the grip force by hands and therefore require to consistently keep the hands in a dry condition or require to increase the friction force provided by hands. Among these exercises, the rock climbing is an emerging exercise in recent years. Seasoned and skilled climbers climb natural or artificial rocks with a variety of angles by using their limbs. Usually climber's hands will sweat during exercising which affects the grip force for griping the rock holds, so the climber often uses the chalk bag or powder bag strapped to the waist of the climber to carry with grip powder therein. Usually, the grip powder mainly consists of the "magnesium carbonate or calcium carbonate" powder which has an absorbent function and can be used to alleviate and improve slippery condition on the hands caused by sweating while climbing. As if a climber senses it seems that a palm is getting started to sweat and becomes slippery, he/she can take and chalk up the grip powder in the powder bag onto the hand to duly alleviate the slippery condition on the hands. Similarly, gymnastics athletes or weight lifters also use the grip powder filled in a powder tank rather than a bag to prevent the hands and palms from being slippery and sweating.

FIG. 1 is a schematic diagram illustrating a use status for a conventional rock climbing chalk bag. In FIG. 1, a chalk bag 101 is usually strapped or tied to the waist of a climber 102 by a rope or a strap. Often the bag is moved to the back waist of the climber to keep away from the rock wall or rock cliff to avoid affecting the climbing movements. In a rock climbing movement at a relatively low altitude and a shorter distance without the use of ropes (called bouldering activity), the bag may also be placed on the ground or hanged around the climbing area, for providing climbers to chalk the powder up to their hands during resting.

FIG. 2 is a schematic diagram illustrating a conventional rock climbing chalk bag. In FIG. 2, the powder bag is mainly made of a bag body 201 with a cylindrical or a conical shape. The grip powder 207 is filled into and carried by the bag 201. There is an opening and closing element 203 disposed around the bag mouth 202 for preventing the powder from being spilt out during non-use period. Sometimes, a fleece material 205 is applied to be the interior lining for the powder bag, since it can easily catch and attach the powder substance thereon. Climbers can quickly apply the grip powder onto the hand or palms uniformly by touching or catching the fleece interior lining in the bag.

However, it is never so easy to uniformly spread the grip powder over the palms contacting with the rock face by just simply placing the grip powder in the chalk bag. Thus, some climbers like to put an additional spherical object with fleece-made surface catching with the grip powder in the powder bag. By simply holding and grasping the spherical object, climbers can spread and apply the grip powder over their hand or palms quickly and uniformly.

However, it is very possible that the additional spherical object may fall out of the bag bringing together with a few amount of anti-slip powder during the carrying process or the dynamic climbing process, which significantly affects the climbing performance and further causes the safety issue for climbers. Therefore, it is a critical issue for the climbing gear industry regarding how to improve such a defect existing in the conventional technology and how to provide a better powder bag for climbers.

Hence, there is a need to solve the above deficiencies/issues.

SUMMARY

According to the first aspect of the present invention, a powder bag is provided. The powder bag having a top and a first mouth at the top includes a bag body configured to have an internal wall, a major space and a secondary space, wherein the major space and the secondary space is partitioned by a partition interface; and the secondary space configured to have a second mouth and a second switch element for opening and closing the second mouth, connected with the internal wall and used for containing a powdery substance, wherein the partition interface has a porous surface with a plurality of pores and each of the plurality of pores having a dimension which allows a part of the powder substance to transfer from the secondary space to the major space.

According to the second aspect of the present, a powder bag is provided. The powder bag includes a first bag body configured to have a top, a first mouth at the top, an internal wall, an external wall and a major space; and a second bag body included in the first bag body, configured to have a second mouth, a secondary space for containing a powdery substance and a mesh surface and connected with the internal wall of the first bag body by a connection portion, wherein the second bag body is circularly disposed on the internal wall which exceeds a half of a circumference of the internal wall and the mesh surface allows a part of the powder substance to transfer from the secondary space to the major space therethrough.

DESCRIPTION OF THE DRAWINGS

A more complete appreciation of the invention and many of the attendant advantages thereof are readily obtained as the same become better understood by reference to the following detailed description when considered in connection with the accompanying drawing, wherein.

DETAILED DESCRIPTION

Figure 1:
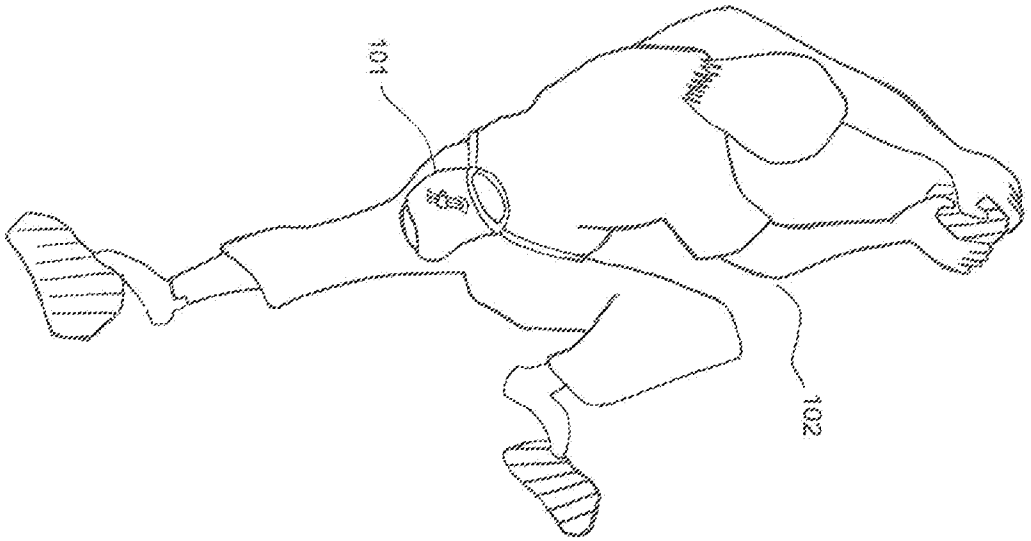
Fig. 1 (Prior Art)
FIG. 1 is a schematic diagram illustrating a use status for a conventional rock climbing chalk bag.
Figure 2:
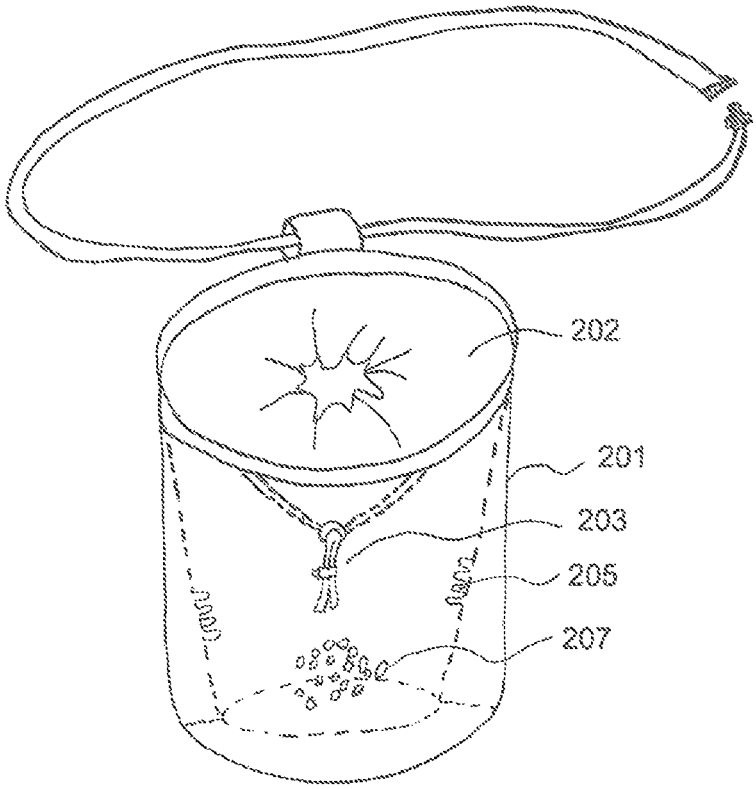
Fig. 2 (Prior Art)
FIG. 2 is a schematic diagram illustrating a conventional rock climbing chalk bag.

The present disclosure will be described with respect to particular embodiments and with reference to certain drawings, but the disclosure is not limited thereto but is only limited by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice.

It is to be noticed that the term "including", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof Thus, the scope of the expression "a device including means A and B" should not be limited to devices consisting only of components A and B.

The disclosure will now be described by a detailed description of several embodiments. It is clear that other embodiments can be configured according to the knowledge of persons skilled in the art without departing from the true technical teaching of the present disclosure, the claimed disclosure being limited only by the terms of the appended claims.

Figure 3:
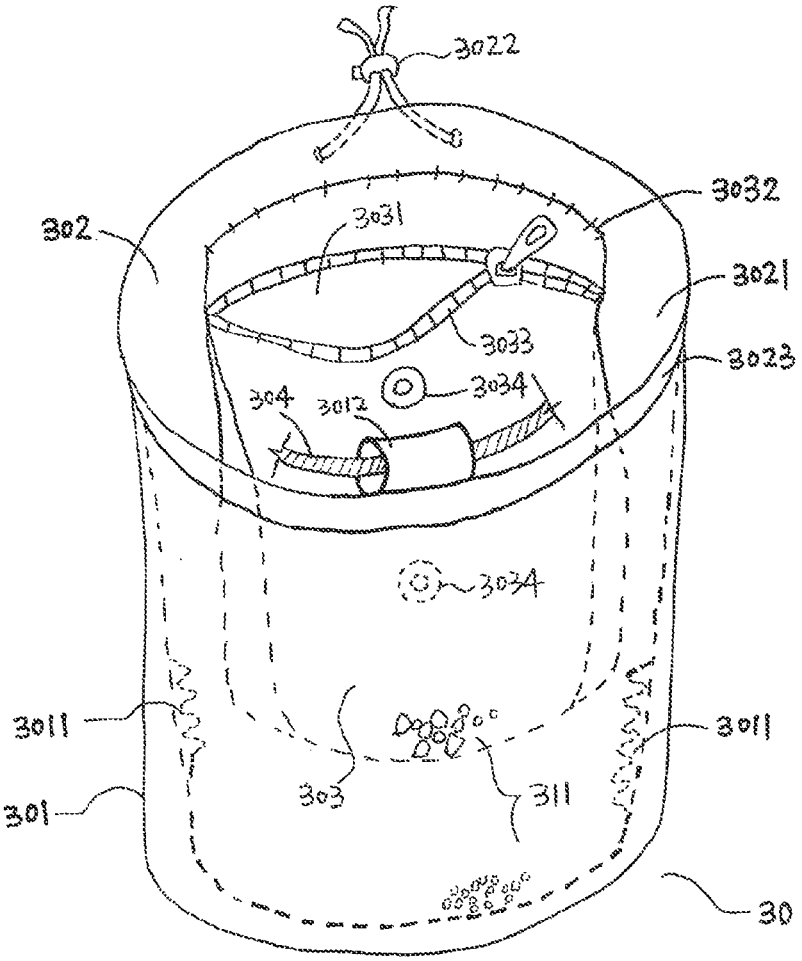
FIG. 3 is a schematic diagram illustrating a first embodiment for a powder bag structure in accordance with the present invention.

FIG. 3 is a schematic diagram illustrating a first embodiment for a powder bag structure in accordance with the present invention. In FIG. 3, a powder bag 30 has a bag body 301 and the bag body 301 includes a major space 302 and a secondary space 303.

The major space 302 is configured to have a first mouth 3021 at the top of the bag body 301 and a first switch element 3022, which is operable for opening or closing the first mouth 3021. A circular support frame 3023 is disposed at and along the edge of the first mouth 3021 and is functioned to cause the first mouth 3021 to be opened in a maximum status and in a nearly circular shape when the first mouth opens, which renders and facilitates a user's hand or palm being capable of quickly and smoothly reaching for the powder 311 contained in the bag body 301. The powder substance 311 in the bag body 301 is preferably one selected from a group consisting of a chalk powder, a magnesium carbonate, a calcium carbonate and a combination thereof The secondary space 303 is configured to have a second mouth 3031 around the top of the bag 301 and a connection portion 3032 connected with the internal wall of the bag body 301. The connection portion 3032 is preferably one selected from a group consisting of a suture link, a zipper link, a loop and hook fastening gear (Velcro fastening system), a button link and other removable and detachable linkage gear. The secondary space 303 is configured to be formed by a porous or a mesh-like material for containing a powder substance 311. The porous or a mesh-like material has multiple pores with an appropriately predetermined dimension, which allows a part of the powder substance 311 contained in the secondary space 303 to gradually pass therethrough to transfer into the major space 302. A fleece-made material is optionally disposed on the internal wall 3011, also the internal wall of the major space 302, of the bag body 301, in order to increase the efficiency to reach for the powder substance for a user.

The second mouth 3031 is configured to have a second switch element 3033, which is operable for opening and closing the second mouth 3031. While the second mouth 3031 is in an opened status, it is operable for being easily placed a massive amount of powder substance 311 thereinto, and while the second mouth 3031 is in a close status, it can prevent the powder substance 311 in the secondary space 303 from being spilt thereout.

Preferably, the powder bag 30 is further configured to have a pair of first and second fixing elements 3034, where the first fixing element 3034 is disposed at an external surface of the secondary space 303 and the second fixing element 3034 is disposed at an internal surface of the major space 302 that is opposite and corresponding to the external surface of the secondary space 303. The pair of first and second fixing elements 3034 can connect with each other to keep the second mouth 3031 to be continuously opened, in order to supplement or reload the powder into the secondary space 303, or in order to cause it is possible that a user's hand or palm being capable of directly reaching for the powder contained in the secondary space 303.

Preferably, the secondary space 303 is configured to be an independent bag body for providing a user to grasp, so that the user can quickly and easily apply the powder substance onto the hands or palms by grasping the independent bag body.

Preferably, the powder bag 30 further has a fixing ring 3012 disposed on the bag body 301. The powder bag 30 can be suspended or fixed at a specific height, or be strapped to the waists of climbers by a strap 304 passing through the fixing ring 3012 so that climbers can reach for the powder substance 311 during climbing.

The first switch element 3022 is preferably one selected from a group consisting of a zipper closure, a drawstring closure, a Velcro closure, a button closure, a buckle closure, a roll top closure, a magnet closure, a lid closure and other switch element that is ease to be operated.

The second switch element 3033 is preferably one selected from a group consisting of a zipper closure, a drawstring closure, a Velcro closure, a button closure, a buckle closure, a roll top closure, a magnet closure, a lid closure and other switch element that is ease to be operated.

The first fixing element 3034 is preferably one selected from a group consisting of a Velcro fastening gear, a button, a buckle, a magnet or other fixing element that is ease to the external side of the second mouth 3031 of the secondary space 303 to the opposite internal side of the major space 302.

Preferably, the secondary space 303 is disposed at one side of the internal wall of the bag body 301 opposite to another side of the internal wall on which the fixing ring 3012 is disposed, so that while the powder bag 30 is strapped to the back waist of a climber by a strap passing through the fixing ring 3012, the climber can use an ergonomic hand gesture that the hand and arm naturally hang down and the palm naturally points outwards the wall in climbing which gesture does not twist the wrist of the hand, to pat or hold the porous or a mesh-like material surface of the secondary space 303, so as to efficiently apply the powder 311 in the secondary space 303 onto the palm.

Figure 4A:
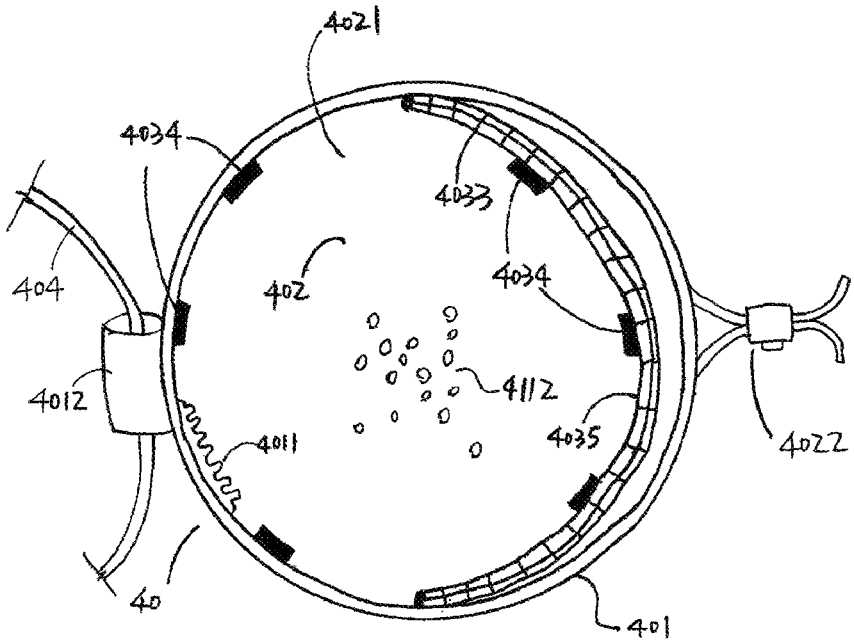
FIG. 4(A) is a top view schematic diagram illustrating a second embodiment for a powder bag with a secondary space in a closed status in accordance with the present invention.
Figure 4B:
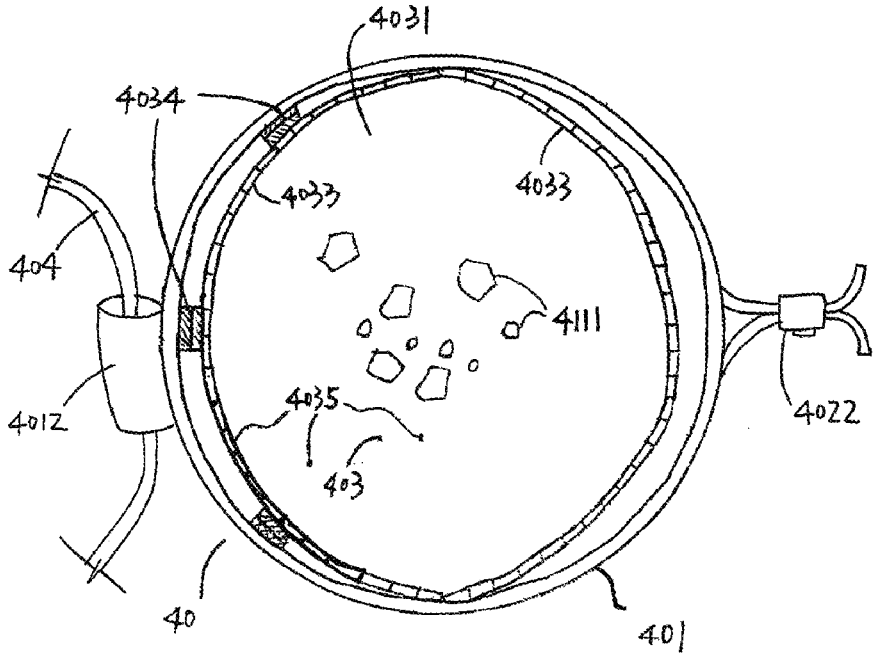
FIG. 4(B) is a top view schematic diagram illustrating a second embodiment for a powder bag with a secondary space in an opened status in accordance with the present invention.

FIGS. 4(A) and 4(B) are schematic diagrams illustrating a second embodiment for a powder bag structure in accordance with the present invention. FIG. 4(A) is a top view schematic diagram illustrating a second embodiment for a powder bag with the secondary space in a closed status in accordance with the present invention. FIG. 4(B) is a top view schematic diagram illustrating a second embodiment for a powder bag with the secondary space in an opened status in accordance with the present invention. In both FIGS. 4(A) and 4(B), a powder bag 40 has a bag body 401 and the bag body includes a major space 402 and a secondary space 403 (not shown in FIG. 4(A)).

The major space 402 is configured to have a first mouth 4021 at the top of the bag body 401 and a first switch element 4022, which is operable for opening or closing the first mouth 4021. A circular support frame 4023 is disposed at and along the edge of the first mouth 4021 and is functioned to cause the first mouth 4021 to be opened in a maximum status in a nearly circular shape, which renders and facilitates a user's hand or palm being capable of quickly and smoothly reaching for the powder contained in the bag body 401. The powder substance in the bag body 401 is preferably one selected from a group consisting of a chalk powder, a magnesium carbonate, a calcium carbonate and a combination thereof.

The secondary space 403 is configured to have a second mouth 3031 around the top of the bag body 401 and a second switch element 4033, which is operable for opening and closing the second mouth 4031. While the second mouth 4031 is in an opened status, it is operable for being easily placed a massive amount of powder substance 4111 thereinto, and while the second mouth 4031 is in a close status, it can prevent the powder substance 4111 from being spilt thereout.

The major space 402 and the secondary space 403 are separated to each other by a partition interface 4035. The partition interface 4035 consists of a porous or a mesh-like material and is stitched onto the internal surface of the bag body 401 by suture or other connecting scheme. While the second mouth 4031 is in an opened status (as shown in FIG. 4(B)), the powder substance 4111 can be poured directly into the secondary space 403. After the powder substance 4111 is duly cracked or fragmentized (since the powder substance 4111 may aggregate together to form multiple conglomerations), the powder will pass the partition interface 4035 and transfer to the major space 402. It is optionally to dispose a fleece-made surface on the internal surface 4011 of the bag body 401, in order to increase the efficiency to reach for the powder substance for a user.

Preferably, the powder bag 40 is further configured to have a pair of first and second fixing elements 4034, where the first fixing element 4034 is disposed at an external surface of the partition interface 4035 and the second fixing element 4034 is disposed at an internal surface of the major space 402 that is opposite and corresponding to the external surface of the partition interface 4035. The pair of first and second fixing elements 4034 can connect with each other to keep the second mouth 4031 to be continuously opened, in order to supplement or reload the powder into the secondary space 403, or in order to cause it is possible that a user's hand or palm being capable of directly reaching for the powder contained in the secondary space 403.

The first switch element 4022 is preferably one selected from a group consisting of a zipper closure, a drawstring closure, a Velcro closure, a button closure, a buckle closure, a roll top closure, a magnet closure, a lid closure and other switch element that is ease to be operated.

The second switch element 4033 is preferably one selected from a group consisting of a zipper closure, a drawstring closure, a Velcro closure, a button closure, a buckle closure, a roll top closure, a magnet closure, a lid closure and other switch element that is ease to be operated.

The first fixing element 4034 is preferably one selected from a group consisting of a Velcro fastening gear, a button, a buckle, a magnet or other fixing element that is ease to the external side of the second mouth 4031 of the secondary space 403 to the opposite internal side of the major space 402.

Preferably, the powder bag 40 further has a fixing ring 4012 on the bag body 401. The powder bag 40 can be suspended or fixed at a specific height, or be strapped to the waists of climbers by a strap 404 passing through the fixing ring 4012 so that a user can reach for the powder substance 4111 during climbing.

Preferably, the secondary space 403 is disposed at one side of the internal wall of the bag body 401 opposite to another side of the internal wall on which the fixing ring 4012 is disposed, so that while the powder bag 40 is strapped to the back waist of a climber by a strap passing through the fixing ring 4012, the climber can use an ergonomic hand gesture that the hand and arm naturally hang down and the palm naturally points outwards the wall in climbing which gesture does not twist the wrist of the hand, to pat the porous or a mesh-like material surface of the partition interface 4035, so as to efficiently apply the powder 4111 in the secondary space 403 onto the palm.

Figure 5A:
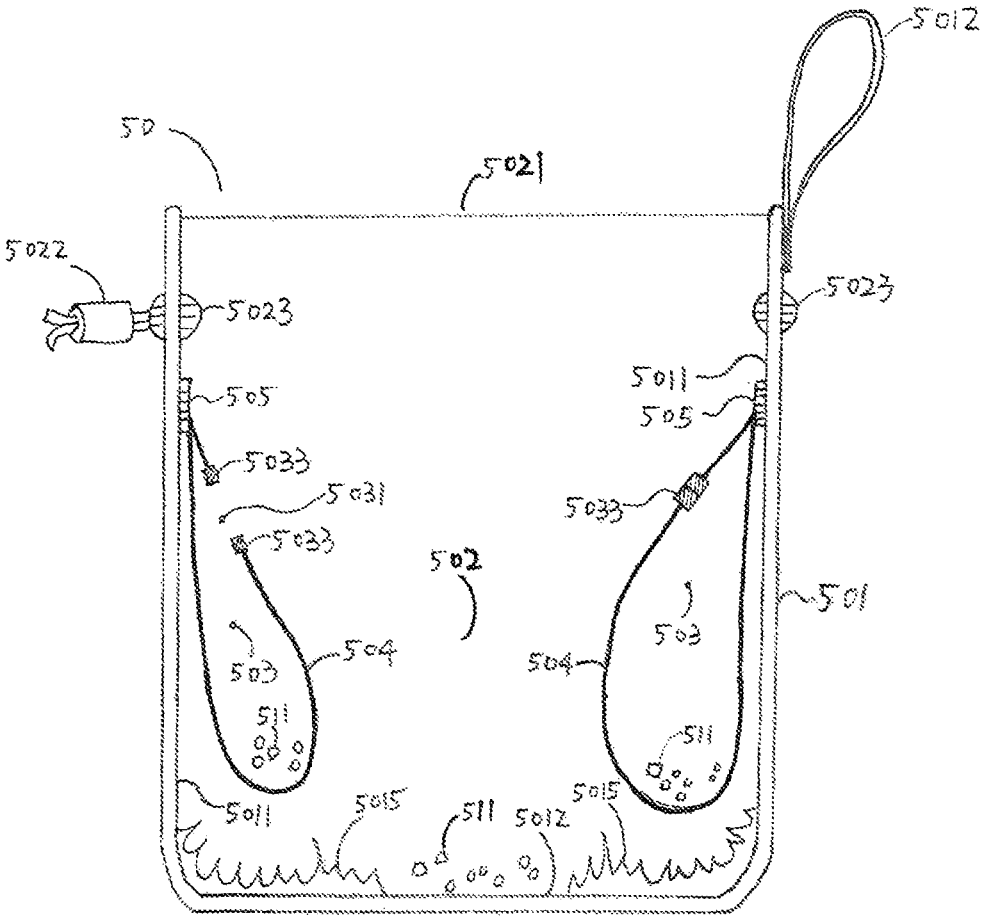
FIG. 5(A) is a cross-section view schematic diagram illustrating a third embodiment for a powder bag structure in accordance with the present invention.

FIG. 5(A) is a cross-section view schematic diagram illustrating a third embodiment for a powder bag structure in accordance with the present invention. In FIG. 5, a powder bag 50 has a first bag body 501 and a second bag body 504, and the first bag body 501 includes a major space 502 and a secondary space 503.

The major space 502 is configured to have a first mouth 5021 at the top of the first bag body 501 and a first switch element 5022 which is operable for opening or closing the first mouth 5021. A circular support frame 5023 is disposed at and along the edge of the first mouth 5021 and is functioned to cause the first mouth 5021 to be opened in a maximum status and in a nearly circular shape, which renders and facilitates a user's hand or palm being capable of quickly and smoothly reaching for the powder 511 contained in the first bag body 501. The powder substance 511 in the first bag body 501 is preferably one selected from a group consisting of a chalk powder, a magnesium carbonate, a calcium carbonate and a combination thereof The secondary space 503 for containing a powder substance 511 is surrounded by the second bag body 504. The second bag body 504 includes a partition interface and is connected with the internal wall 5011 of the first bag body 501 through a connection portion 505. The partition interface consists of a porous or a mesh-like material. The porous or a mesh-like material has multiple pores with an appropriately predetermined dimension, which allows a part of the powder substance 511 contained in the secondary space 503 to gradually pass therethrough to transfer into the major space 502.

The connection portion 505 is preferably one selected from a group consisting of a suture link, a zipper link, a loop and hook fastening gear (Velcro fastening system), a button link and other removable and detachable linkage gear.

The secondary space 503 is configured to have a second mouth 5031 and the second mouth 5031 is configured to have a second switch element 5033 along the edge thereof, which is operable for opening and closing the second mouth 5031. While the second mouth 5031 is in an opened status, it is operable for being easily placed a massive amount of powder substance 511 thereinto, and while the second mouth 5031 is in a close status, it can prevent the powder substance 511 in the secondary space 503 from being spilt thereout.

Figure 5B:
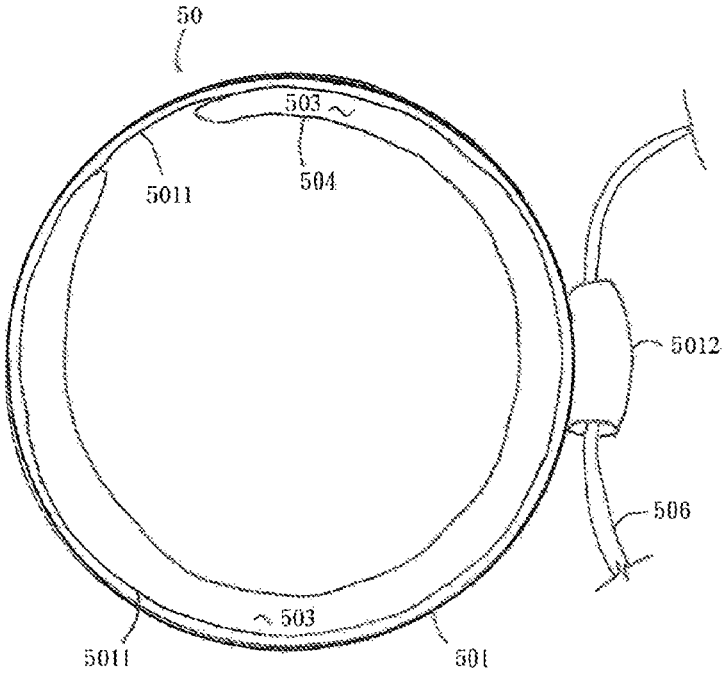
FIG. 5(B) is a top view schematic diagram illustrating a third embodiment for a powder bag structure in accordance with the present invention.

FIG. 5(B) is a top view schematic diagram illustrating a third embodiment for a powder bag structure in accordance with the present invention. In FIG. 5(B), the secondary space 503 is circularly disposed along the internal wall 5011 of the first bag body 501 which exceeds a half of a circumference of the internal wall 5011 for which a user easily reaches for the powder substance 511 in the second bag body 504.

Preferably, the secondary space 503 is circularly disposed on the internal wall 5011 of the first bag body 501 for over at least two-thirds of a circumference of the internal wall 5011.

Preferably, the secondary space 503 is circularly disposed on the internal wall 5011 of the first bag body 501 for fully covering the circumference of the internal wall 5011.

Preferably, the second switch element 5033 is a zipper closure and the zipper closure is a waterproof zipper with a coated layer or a laminated layer. The coated layer or a laminated layer can effectively prevent the powder substance 511 from passing through the intertooth gape of zipper.

Preferably, the first switch element 5022 is a cord with or without a cord lock buckle, around which an elastic fabric surrounds. The elastic fabric has a coated layer for preventing the powder substance 511 from being leaking thereout.

Preferably, the powder bag 50 further has a fixing ring 5012 on the bag body 501. The powder bag 50 can be suspended or fixed at a specific height, or be strapped to the waists of climbers by a strap 506 passing through the fixing ring 5012 so that climbers can reach for the powder substance 511 during climbing.

Preferably, the secondary space 503 is disposed at one side of the internal wall of the bag body 501 opposite to another side of the internal wall on which the fixing ring 5012 is disposed, so that while the powder bag 50 is strapped to the back waist of a climber through the fixing ring 5012, the climber can use an ergonomic hand gesture that the hand and arm naturally hang down and the palm naturally points outwards the wall in climbing which gesture does not twist the wrist of the hand, to pat or hold the porous or a mesh-like material surface of the secondary space 503, so as to efficiently apply the powder 511 in the secondary space 503 onto the palm.

Preferably, a fleece-made material 5015 is disposed on the internal wall 5011 and the bottom wall 5012 of the first bag body 501, in order to increase the efficiency to reach for the powder substance 511 for a user.

The first switch element 5022 is preferably one selected from a group consisting of a zipper closure, a drawstring closure with or without a cord lock, a Velcro closure, a button closure, a buckle closure, a roll top closure, a magnet closure, a lid closure and other switch element that is ease to be operated.

The second switch element 5033 is preferably one selected from a group consisting of a zipper closure, a drawstring closure, a cord lock buckle, a Velcro closure, a button closure, a buckle closure, a roll top closure, a magnet closure, a lid closure and other switch element that is ease to be operated.

Figure 6:
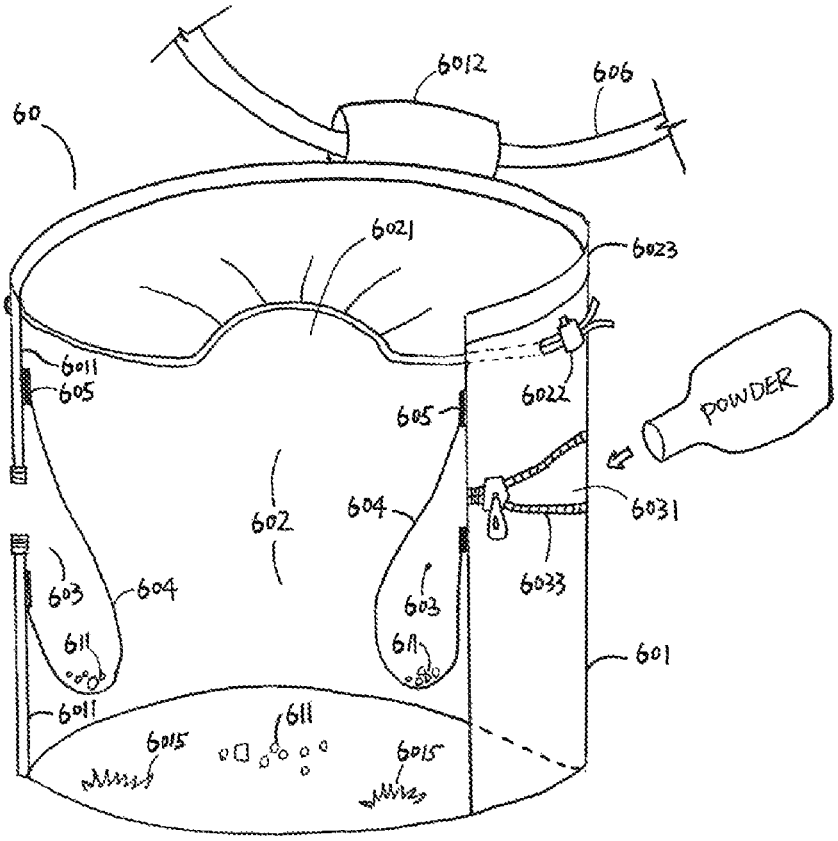
FIG. 6 is a cross-section view schematic diagram illustrating a fourth embodiment for a powder bag structure in accordance with the present invention.

FIG. 6 is a cross-section view schematic diagram illustrating a fourth embodiment for a powder bag structure in accordance with the present invention. In FIG. 6, a powder bag 60 has a first bag body 601 and a second bag body 604, and the first bag body 601 includes a major space 602 and a secondary space 603.

The major space 602 is configured to have a first mouth 6021 at the top of the first bag body 601 and a first switch element 6022 which is operable for opening or closing the first mouth 6021. A circular support frame 6023 is disposed at and along the edge of the first mouth 6021 and is functioned to cause the first mouth 6021 to be opened in a maximum status and in a nearly circular shape, which renders and facilitates a user's hand or palm being capable of quickly and smoothly reaching for the powder 611 contained in the first bag body 601.

The secondary space 603 for containing a powder substance 611 is surrounded by the second bag body 604. The second bag body 604 includes a partition interface and is connected with the internal wall 6011 of the first bag body 601 through a connection portion 605. The partition interface consists of a porous or a mesh-like material. The porous or a mesh-like material has multiple pores with an appropriately predetermined dimension, which allows a part of the powder substance 611 contained in the secondary space 603 to gradually pass therethrough to transfer into the major space 602.

The connection portion 605 is preferably one selected from a group consisting of a suture link, a zipper link, a loop and hook fastening gear (Velcro fastening system), a button link and other removable and detachable linkage gear.

The secondary space 603 is configured to have a second mouth 6031 and the second mouth 6031 is disposed at the external surface of the first bag body 601. The second mouth 6031 is further configured to have a second switch element 6033 along the edge thereof, which is operable for opening and closing the second mouth 6031. While the second mouth 6031 is in an opened status, it is operable for being easily placed a massive amount of powder substance 611 thereinto, and while the second mouth 6031 is in a close status, it can prevent the powder substance 611 in the secondary space 603 from being spilt thereout.

Preferably, the second switch element 6033 is a zipper closure and the zipper closure is a waterproof zipper having a tooth surface and a waterproof coating surface (also a waterproof laminated surface). The waterproof coating layer can effectively prevent the powder substance 611 from passing through the intertooth gape of the zipper. The waterproof coating surface is situated at an internal wall of the second bag body 604 and the tooth surface is situated at an external wall of the second bag body 604 for preventing a failure caused by the powder substance entering into the intertooth gape.

Preferably, the second bag body 604 is a circular bag body, which surrounds along the internal wall of the first bag body 601, for which a user easily reaches for the powder substance 611 in the second bag body 604.

Preferably, the secondary space 603 in the second bag body 604 is capable of being partitioned into several subspaces, to cause the powder substance 611 distributing in the secondary space 603 more uniformly.

Preferably, the porous partition interface of the second bag body 604 can have different pore dimension to cause the powder substance 611 therein to pass therethrough into the major space 602 with different rate.

Preferably, a fleece-made material is disposed on the internal wall 6011 and the bottom wall 6015 of the first bag body 601, in order to increase the efficiency to reach for the powder substance 611 for a user.

Preferably, the powder bag 60 further has a fixing ring 6012 on the bag body 601. The powder bag 60 can be suspended or fixed at a specific height, or be strapped to the waists of climbers by a strap 606 passing through the fixing ring 6012 so that climbers can reach for the powder substance 611 during climbing.

The secondary space 603 is preferably disposed, but is not limited to, at one side of the internal wall of the bag body 601 opposite to another side of the internal wall on which the fixing ring 6012 is disposed, so that while the powder bag 60 is strapped to the back waist of a climber through the fixing ring 6012, the climber can use an ergonomic hand gesture that the hand and arm naturally hang down and the palm is naturally outwards the wall in climbing which gesture does not twist the wrist of the hand, to pat or hold the porous or a mesh-like material surface of the secondary space 603, so as to efficiently apply the powder 611 in the secondary space 603 onto the palm.

Preferably, the bag body 60 is in a cylindrical bag body, a flat bag body, a tapered quasi-conical bag body, a tapered curved bag body or a trapezoidal bag body.

Preferably, the bag body 60 is a firm tube structure.

By the above-mentioned outstanding design, a climber can put or fill a chalk powder, a grip powder or an anti-slip powder into the powder bag more easily and apply the powder onto the palm more massively, uniformly and efficiently, which causes a very good chalk-up efficiency. At the same time, it also reduces the occasions the powder is spilt out of the powder bag during the movement. Furthermore, since the secondary space is secured to the internal side of the major space, it will not fall out of the powder bag. In addition, by providing the first fixing element, a climber can decide to directly reach for coarser powder contained in the secondary space by hands or to reach for finer powder filtered by the porous or the mesh-like material and contained the major space depending on climber's habit.

The present invention can be particularly applied to any works or exercises requiring to grab a uniform powder, in addition to the rock climbing, the gymnastics or the aloft work, the painting work, gymnastics athletes or weight lifters also require to reach for the powder during activity. The present invention can be also applied to the conventional powder tank or the conventional powder bag for these activities to increase the efficiency of grabbing the powder.

To sum up, the improved powder bag in accordance with the present invention can effectively overcome the defects existing in the prior art, which significantly raise the efficiency and convenience of the use for a powder bag. There are further embodiments provided as follows.

Embodiment 1: A powder bag having a top and a first mouth at the top includes a bag body configured to have an internal wall, a major space and a secondary space, wherein the major space and the secondary space is partitioned by a partition interface; and the secondary space configured to have a second mouth and a second switch element for opening and closing the second mouth, connected with the internal wall and used for containing a powdery substance, wherein the partition interface has a porous surface with a plurality of pores and each of the plurality of pores having a dimension which allows a part of the powder substance to transfer from the secondary space to the major space.

Embodiment 2. The powder bag according to Embodiment 1, the first mouth has a first switch element for opening and closing the first mouth and the first switch element is capable of closing the first mouth for a long time.

Embodiment 3. The powder bag according to Embodiment 2, the first switch element and the second switch element are respectively one selected from a group consisting of a zipper closure, a drawstring closure, a Velcro closure, a button closure, a buckle closure, a roll top closure, a magnet closure, a lid closure and a combination thereof and the second switch element is situated near to the top.

Embodiment 4. The powder bag according to Embodiment 1 further includes a support frame disposed at and along an edge of the first mouth to cause the first mouth to be opened in a maximum status during opening.

Embodiment 5. The powder bag according to Embodiment 1 further includes a first fixing element disposed at an external surface of the secondary space and a second fixing element disposed at an internal surface of the major space that is opposite and corresponding to the external surface, where the first and second fixing elements can connect with each other to keep the second mouth to be continuously opened.

Embodiment 6. The powder bag according to Embodiment 5, the first fixing element and the second fixing element are respectively one selected from a group consisting of a Velcro fastening gear, a button, a buckle, a magnet and a combination thereof Embodiment 7. The powder bag according to Embodiment 1, the secondary space has a size smaller than that of the bag body, and is connected with the internal wall of the bag body by a connection portion.

Embodiment 8. The powder bag according to Embodiment 1, the connection portion is one selected from a group consisting of a suture link, a zipper link, a Velcro fastening gear, a button link and a combination thereof Embodiment 9. The powder bag according to Embodiment 1 further includes a fixing ring disposed on the bag body through which the powder bag is suspended or fixed at a specific height by a strap passing.

Embodiment 10. The powder bag according to Embodiment 9, the secondary space is disposed at one side of the internal wall of the bag body opposite to another side of the internal wall on which the fixing ring is disposed.

Embodiment 11. The powder bag according to Embodiment 9, the bag body is in a cylindrical shape and is a firm tube structure and the powder substance is one selected from a group consisting of a chalk powder, a magnesium carbonate, a calcium carbonate and a combination thereof Embodiment 12. The powder bag according to Embodiment 1 further includes a strap by which the powder bag is strapped to the waists of climbers.

Embodiment 13. A powder bag includes a first bag body configured to have a top, a first mouth at the top, an internal wall, an external wall and a major space; and a second bag body included in the first bag body, configured to have a second mouth, a secondary space for containing a powder substance and a mesh surface and connected with the internal wall of the first bag body by a connection portion, wherein the second bag body is circularly disposed on the internal wall which exceeds a half of a circumference of the internal wall and the mesh surface allows a part of the powder substance to transfer from the secondary space to the major space therethrough.

Embodiment 14: The powder bag according to Embodiment 13, the second bag body is distributed on the internal wall for over two-thirds of the circumference.

Embodiment 15: The powder bag according to Embodiment 13, the second bag body is distributed on the internal wall for fully covering the circumference.

Embodiment 16: The powder bag according to Embodiment 13, the first mouth has a first switch element for opening and closing the first mouth and the second mouth has a second switch element proximal to the first mouth and for opening and closing the second mouth.

Embodiment 17: The powder bag according to Embodiment 16, the second switch element is a waterproof zipper having a waterproof coating surface and a tooth surface and the waterproof coating surface is situated at an internal wall of the second bag body and the tooth surface is situated at an external wall of the second bag body.

Embodiment 18: The powder bag according to Embodiment 13, the second mouth is opened at the external wall of the first bag body.

Embodiment 19: The powder bag according to Embodiment 13 further includes a support frame disposed at and along an edge of the first mouth to cause the first mouth to be opened in a maximum status during opening.

Embodiment 20: The powder bag according to Embodiment 13, the powder substance is placed into the secondary space through the second mouth.

While the disclosure has been described in terms of what are presently considered to be the most practical and preferred embodiments, it is to be understood that the disclosure need not be limited to the disclosed embodiments. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present disclosure which is defined by the appended claims.

What is claimed is:

1. A powder bag having a top and a first mouth at the top, comprising:

a bag body having an internal wall, a major space and a secondary space, wherein the major space and the secondary space is partitioned by a partition interface; and the secondary space inside the major space, being in a pocket based shape, having a second mouth and a second switch element for opening and closing the second mouth, connected with the internal wall and used for containing a powder substance, wherein the secondary mouth is inside the major space, the secondary mouth faces toward the first mouth and has a dimension up to that of the first mouth when opened, and the partition interface has a porous surface with a plurality of pores and each of the plurality of pores having a dimension which allows a part of the powder substance to transfer from the secondary space to the major space.

2. The powder bag according to claim 1, wherein the first mouth has a first switch element for opening and closing the first mouth and the first switch element is capable of closing the first mouth for a long time.

3. The powder bag according to claim 2, wherein the first switch element and the second switch element are respectively one selected from a group consisting of a zipper closure, a drawstring closure, a Velcro closure, a button closure, a buckle closure, a roll top closure, a magnet closure, a lid closure and a combination thereof and the second switch element is situated near to the top.

4. The powder bag according to claim 1, further comprising a support frame disposed at and along an edge of the first mouth to cause the first mouth to be opened in a maximum status during opening.

5. The powder bag according to claim 1, further comprising a first fixing element disposed at an external surface of the secondary space and a second fixing element disposed at an internal surface of the major space that is opposite and corresponding to the external surface, where the first and second fixing elements can connect with each other to keep the second mouth to be continuously opened.

6. The powder bag according to claim 5, wherein the first fixing element and the second fixing element are respectively one selected from a group consisting of a Velcro fastening gear, a button, a buckle, a magnet and a combination thereof.

7. The powder bag according to claim 1, wherein the secondary space has a size smaller than that of the bag body, and is connected with the internal wall of the bag body by a connection portion.

8. The powder bag according to claim 7, wherein the connection portion is one selected from a group consisting of a suture link, a zipper link, a Velcro fastening gear, a button link and a combination thereof.

9. The powder bag according to claim 1, further comprising a fixing ring disposed on the bag body through which the powder bag is suspended or fixed at a specific height by a strap passing.

10. The powder bag according to claim 9, wherein the secondary space is disposed at one side of the internal wall of the bag body opposite to another side of the internal wall on which the fixing ring is disposed.

11. The powder bag according to claim 9, wherein the bag body is in a cylindrical shape and is a firm tube structure and the powder substance is one selected from a group consisting of a chalk powder, a magnesium carbonate, a calcium carbonate and a combination thereof.

12. The powder bag according to claim 1, further comprising a strap by which the powder bag is strapped to the waists of climbers.

13. A powder bag, comprising:

a first bag body having a top, a first mouth at the top, an internal wall, an external wall and a major space; and a second bag body included in the first bag body, being in a pocket based shape, having a second mouth, a secondary space for containing a powder substance and a mesh surface, and connected with the internal wall of the first bag body by a connection portion, wherein the secondary mouth is inside the major space, the secondary mouth faces toward the first mouth and has a dimension up to that of the first mouth when opened, and the second bag body is circularly disposed on the internal wall which exceeds a half of a circumference of the internal wall and the mesh surface allows a part of the powder substance to transfer from the secondary space to the major space therethrough.

14. The powder bag according to claim 13, wherein the second bag body is distributed on the internal wall for over two-thirds of the circumference.

15. The powder bag according to claim 13, wherein the second bag body is distributed on the internal wall for fully covering the circumference.

16. The powder bag according to claim 13, wherein the first mouth has a first switch element for opening and closing the first mouth and the second mouth has a second switch element proximal to the first mouth and for opening and closing the second mouth.

17. The powder bag according to claim 16, wherein the second switch element is a waterproof zipper having a waterproof coating surface and a tooth surface and the waterproof coating surface is situated at an internal wall of the second bag body and the tooth surface is situated at an external wall of the second bag body.

18. The powder bag according to claim 13, wherein the second mouth is opened at the external wall of the first bag body.

19. The powder bag according to claim 13, further comprising a support frame disposed at and along an edge of the first mouth to cause the first mouth to be opened in a maximum status during opening.

20. The powder bag according to claim 13, wherein the powder substance is placed into the secondary space through the second mouth.

* * * * *